United States Patent [19]

Umemura et al.

[11] 4,369,739

[45] Jan. 25, 1983

[54] STRUCTURE OF A CYLINDER ASSEMBLY FOR AN INTERNAL COMBUSTION ENGINE

[75] Inventors: Yukio Umemura, Yokosuka; Isao Yoshida, Fujisawa; Yoshio Taguchi, Yokohama; Yoshio Iwasa, Nagareyama, all of Japan

[73] Assignee: Nissan Motor Company, Limited, Yokohama, Japan

[21] Appl. No.: 147,336

[22] Filed: May 6, 1980

[30] Foreign Application Priority Data

May 7, 1979 [JP] Japan ..... 54-60389[U]
Jun. 26, 1979 [JP] Japan ..... 54-87164[U]

[51] Int. Cl.[3] ..... F01P 3/02
[52] U.S. Cl. ..... 123/41.74; 123/41.79
[58] Field of Search ..... 123/41.28, 41.72, 41.74, 123/41.79, 195 R; 277/235 B

[56] References Cited

U.S. PATENT DOCUMENTS

| | | | |
|---|---|---|---|
| 2,001,225 | 5/1935 | Victor | 277/235 B |
| 2,139,170 | 6/1938 | Murphy | 123/41.79 |
| 3,156,224 | 11/1964 | Winkler | 123/41.72 |
| 3,168,081 | 2/1965 | Bauer | 123/41.74 |
| 3,173,407 | 3/1965 | Sampietro et al. | 123/41.74 |
| 3,315,651 | 4/1967 | Dangauthier | 123/41.28 |
| 3,942,487 | 3/1976 | Zink | 123/41.79 |
| 3,983,852 | 10/1976 | Chatourel | 123/195 R |
| 4,083,570 | 4/1978 | Sugawara | 277/235 B |

*Primary Examiner*—Ronald H. Lazarus

*Assistant Examiner*—W. R. Wolfe

*Attorney, Agent, or Firm*—Schwartz, Jeffery, Schwaab, Mack, Blumenthal & Koch

[57] ABSTRACT

A structure of a cylinder assembly of an internal combustion engine has a coolant circulating system for cooling the cylinder assembly while the engine is driving. The cylinder assembly generally comprises a cylinder block formed therein a plurality of engine cylinder in line, and a cylinder head sealingly mounted on the cylinder block. The coolant circulating system comprises a coolant chamber formed within the cylinder block so that it surrounds substantial part of each engine cylinder, a return passage formed in the cylinder head. The coolant chamber communicates with the return passage through a plurality of vertical passages. Adjacent the top of the vertical passage, there is provided with a projecting portion inwardly projecting thereto. A sloped passage is formed within a partition disposed between each of adjacent engine cylinder. The upper end of the sloped passage is opened at the projecting portion at right angle to the planar surface of the projecting portion. By forming the projecting portion within the vertical passage and forming the sloped passage extending therefrom at right angle, it makes easy to form the sloped passage within the partition. Further, by forming the sloped passage as the manner mentioned above, the cylinder assembly is easily prevented from leakage of coolant and/or air/fuel mixture discharged to the engine cylinder.

17 Claims, 8 Drawing Figures

STRUCTURE OF A CYLINDER ASSEMBLY FOR AN INTERNAL COMBUSTION ENGINE

BACKGROUND OF THE INVENTION

1. Field of the Invention

The present invention relates generally to a construction of a cylinder assembly of an internal combustion engine, particularly of a multi-cylinder internal combustion engine having therein a plurality of engine cylinders in side-by-side relationship. More specifically, the present invention relates to a structure of a coolant circulation system in the cylinder assembly for cooling the same while the engine is driven.

2. Description of the Prior Art

As is well known to those skilled in the art, a cylinder assembly for an internal combustion engine, particularly such a type that has a plurality of engine cylinders therein (hereinafter referred as multi-cylinder engine), is provided with a coolant circulating system for circulating a coolant such as cooling water for the purpose of cooling the engine temperature while the engine is driven. In a multi-cylinder engine, the coolant circulating system comprises a coolant chamber formed within the cylinder block and a coolant return passage connecting the former to a radiator provided exterior of the cylinder assembly. Generally, the cylinder block of the multi-cylinder engine is provided with a plurality of partitions which are substantially parallel to each other. The partitions of each pair are separated from one another to define therebetween an engine cylinder together with an cylinder wall of the cylinder block. The cylinders are arranged within the cylinder block in-line. The coolant chamber is formed within the outer wall and extends therealong so as to surround a substantial part of each combustion chamber. The coolant chamber communicates with a return passage formed within the cylinder head. The cylinder head is tightly secured on the cylinder block to form closed cylinder assembly with clamping a sealing gasket between the head and block. Between the coolant chamber and the return passage, there are provided with a plurality of passages extending laterally with respect to the lined coolant chambers. The lateral passage are formed within the partitions to cool the partitions while the engine is driven.

Indeed, various constructions of the coolant circulating systems for use with a multi-cylinder engine have been developed. One typical construction is disclosed in Japanese Utility Model Publication No. 52-52113 in which a cylinder block is provided with a plurality of coolant chambers separated from each other. Generally the coolant chambers are aligned along an outer wall of the cylinder block. Each of the coolant chambers communicates with a coolant return passage formed within a cylinder head through a sloped passage formed within a partition. One end of the sloped passage opens at the upper surface of the cylinder block to which the cylinder head is fixedly secured. In order to establish communication between the coolant chamber and the return passage, it is a passage is formed within the cylinder head in alignment with the sloped passage. Further, in this constuction, an a opening aligned to with the sloped passage is formed in the sealing member which is interposed between the cylinder block and the cylinder head. In this construction, since the end of the sloped passage is opened at the portion above the engine cylinder, it is quite difficult and troublesome to form the passage in alignment to the sloped passage in the cylinder head. Forming this passage results in increasing the number of processing steps in manufacturing. Further, the passage through the sealing member for communication between the sloped passage and the return passages increases the possibility of leakage of the coolant and/or air/fuel mixture.

Another conventional construction of the coolant circulating system is disclosed in Japanese Utility Model Publication No. 52-54682, published on Dec. 10, 1977. In this publication, a cylinder block is provided with a plurality of separated coolant chambers disposed between adjacent engine cylinders. The coolant chambers are aligned on both sides of the engine cylinders along the side walls of the cylinder block. The coolant chambers are also aligned in the lateral direction with respect to alignment of the combustion chambers and oppose one another on opposite sides of adjacent chambers. Between opposed coolant chambers, a plurality of sloped passages are formed through a partition defining the engine cylinder and the outer wall of the cylinder block. Although this construction of the coolant circulating system can effectively cool the partition, it is difficult to form these sloped passages within the partition, since it is practically impossible to form vertically aligned passages in the partition. Further, during formation of each passage in the substantially X-shaped configuration as shown in FIG. 3 of the publication having two openings on each engine cylinder, a tool for forming the passage, such as drill and the like, is apt to be deformed or damaged at the closed portion of the X-shaped passage. For avoiding these difficulties it is required that the cylinder block be separated into two portions to form the passages. After forming the passages in the partition, the portions are assembled together to form the cylinder block. In this case, some additional and troublesome processing steps are necessary resulting in inefficiency of manufacturing and increasing the of cost therefor.

In each of above-mentioned conventional system, since the sloped passage has an end opening at acute angle with respect to the axis of the engine cylinder, it is difficult to center the for forming tool. For forming the sloped passage at an exact given angle, high processing accuracy is required. This will necessarily cause inefficiency of manufacturing of the cylinder assembly, and thereby cause increased manufacturing cost.

As mentioned above, conventional constructions of coolant circulating systems for engine cylinder assemblies have some quite serious manufacturing problems associated therewith. Furthermore, smaller and lighter cylinder assemblies are required for saving space in a vehicle and for economizing fuel for driving the engine. To achieve this, it has been necessary to reduce the thickness of the partition as much as possible. However, it is difficult to satisfactorily and sufficiently make the partition thinner, since this will possibly cause inefficient of cooling of the partition due to short coolant passages and thereby causes engine overheating. Also, since the coolant circulates and rises through the coolant chamber, coolant passage, return passage and radiator in that order, if the passages formed within the partition are excessively sloped, the coolant may not circulate therethrough.

To avoid the above-mentioned difficulties and disadvantages, there is provided an improved construction of the cylinder assembly in U.S. Pat. No. 3,942,487, issued in Mar. 9, 1976 to Anton Zink. The Zink Patent discloses a cylinder construction comprising a cylinder block having engine cylinders of disposed in-line, and passage means for coolant arranged between the cast cylinder assembly in the area adjacent the surface separating the cylinder block from the cylinder head. The passage means includes a narrow sloped passage which has a depth corresponding at least approximately to that of a piston ring arrangement of the piston at top dead-center position. The narrow sloped passage intersects adjacent coolant chambers and completely separates the cylinder assembly in the lateral direction of the cylinder wall. The passage extends laterally into the cylinder head bolt bore at the interface between the cylinder block and the cylinder head. However, in this construction, increasing the velocity of circulation of the coolant is impossible, because the passage merely connects the coolant chambers adjacent one another. Therefore, it cannot effectively cool the cylinder block, particularly the partitions extending laterally with respect to the cylinder wall to define the engine cylinder. Further, in the Zink Patent, the openings of the sloped passage formed on the top of the cylinder block are so wide as to be impossible to seal completely. Therefore, this may possibly cause leakage of coolant and/or air/fuel mixture.

The present invention solves the abovementioned difficulties for constructing and disadvantages of the use of the prior art arrangement, and therefore provides an improved construction for the coolant circulating system in a cylinder assembly which system can effectively circulate coolant so as to effectively cool the cylinder assembly and yet can be easily constructed.

SUMMARY OF THE INVENTION

Therefore, it is a principle object of the present invention to provide a structure for the coolant circulating system in a cylinder assembly of an internal combustion engine, which system includes an integrally formed coolant chamber so as to surround a substantial part of the engine cylinders, and a passage connecting each opposed portion of the coolant chamber so that it may permit the coolant to circulate at a relatively high velocity to effectively cool the cylinder block.

Another object of the present invention is to provide a coolant circulating system for the engine cylinder assembly including a passage connecting the opposed portions of the coolant chamber, which passage can be easily formed in the partition of the cylinder block.

A further object of the present invention is to provide a structure of the cylinder assembly having passage connecting opposed portions of the coolant chamber, which passage is sloped at a specific angle with respect to the horizontal upper surface of the cylinder block so that the coolant can be effectively circulated through the system and cool the cylinder block effectively and satisfactorily. According to the present invention, to acheive the above-mentioned and other objects of the invention, there is provided an improved structure of a coolant circulating system formed within a cylinder assembly of an internal combustion engine. The cylinder assembly generally comprises a cylinder block and a cylinder head. A coolant chamber is formed within the cylinder block so that it can surround a substantial part of a plurality of engine cylinders formed therein in-line. The coolant chamber communicates with a radiator at the upstream side thereof. A return passage for recirculating the coolant therethrough is formed within the cylinder head. The return passage communicates with the coolant chamber so that it permits the coolant to circulate therethrough. Narrow slopped passages are formed within partitions which form part of the cylinder assembly and separate each individual engine cylinder. Arround each upper end of the slopped passage, there is provided a projection having a surface into which the upper end of the slopped passage opens at substantially right angle. The projection is located adjacent the top of the cylinder block.

According to the another embodiment of the present invention, there is provided an improvement in and relating to a structure of a cylinder assembly of an internal combustion engine. The cylinder assembly generally comprises a cylinder block and a cylinder head. Within the cylinder block, a plurality of engine cylinders are formed in-line. The upper edge of each engine cylinder is covered with a sealing member comprising a metalic grommet and a heat resistant elastic member.

Other objects and advantages of the present invention will become apparent from hereafter described preferred embodiments of the invention.

BRIEF DESCRIPTION OF THE DRAWINGS

The present invention will become more fully understood from the detailed description given below, and from the accompanying drawings of the several preferred embodiment of the present invention, which, however, are not to be taken limitative of the present invention in any way, but are for the purpose of elucidation and explanation only.

In the drawings.

DESCRIPTION OF THE PREFERRED EMBODIMENTS

Figure 1:
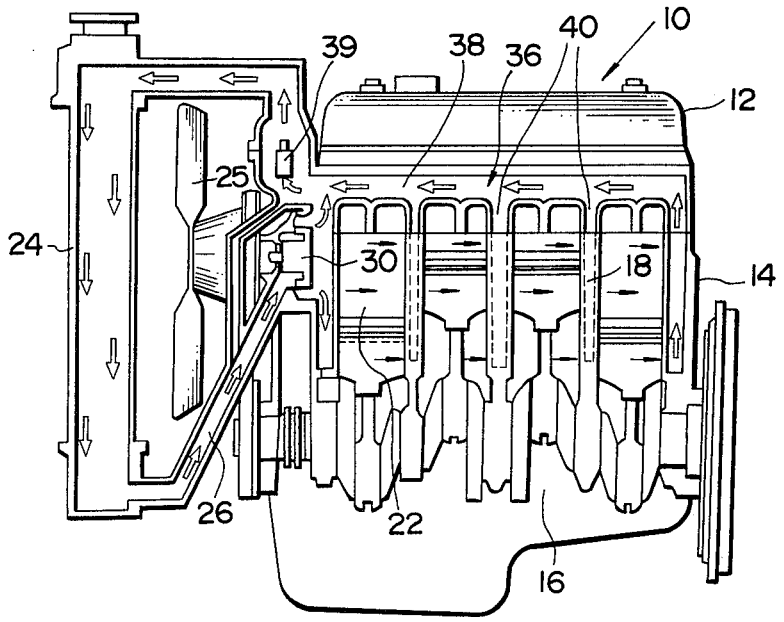
FIG. 1 is a partially sectioned side elevational view of a cylinder assembly, showing a general construction thereof.
Figure 2:
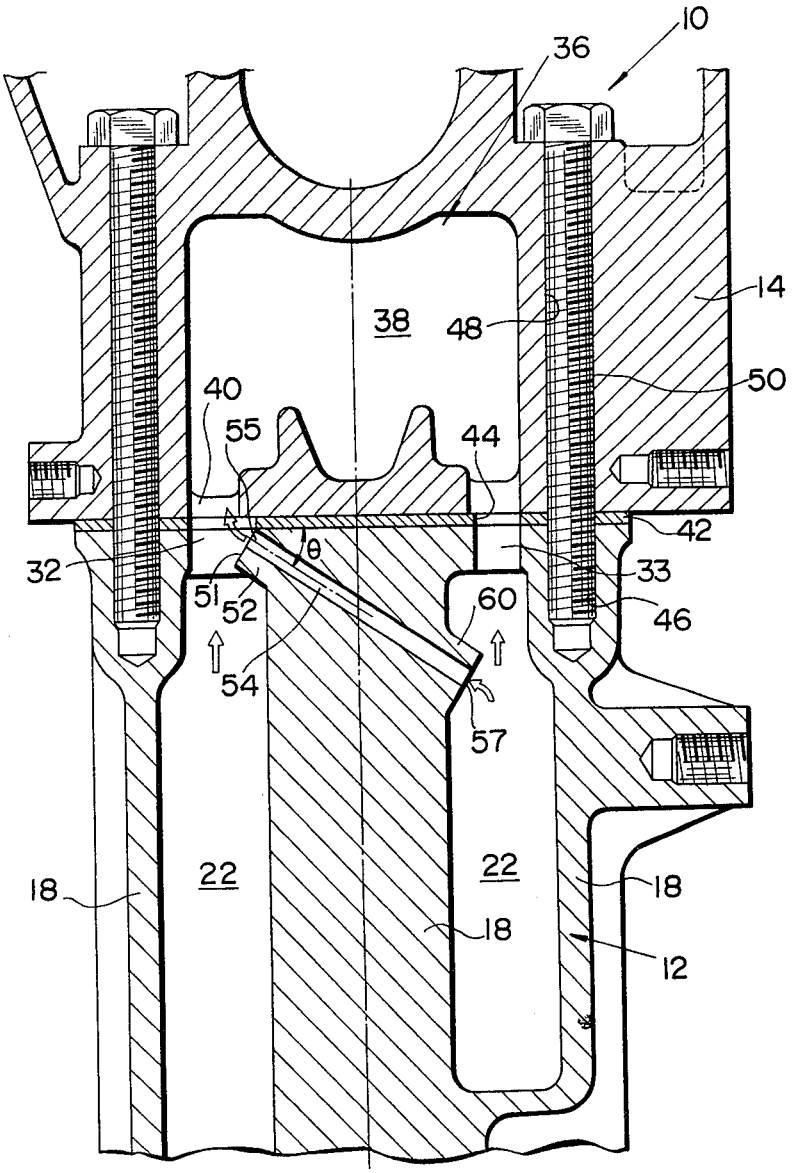
FIG. 2 is an enlarged partial sectional view of the cylinder assembly of FIG. 1, wherein is illustrated a coolant circulating system according to the first embodiment of the present invention.
Figure 3:
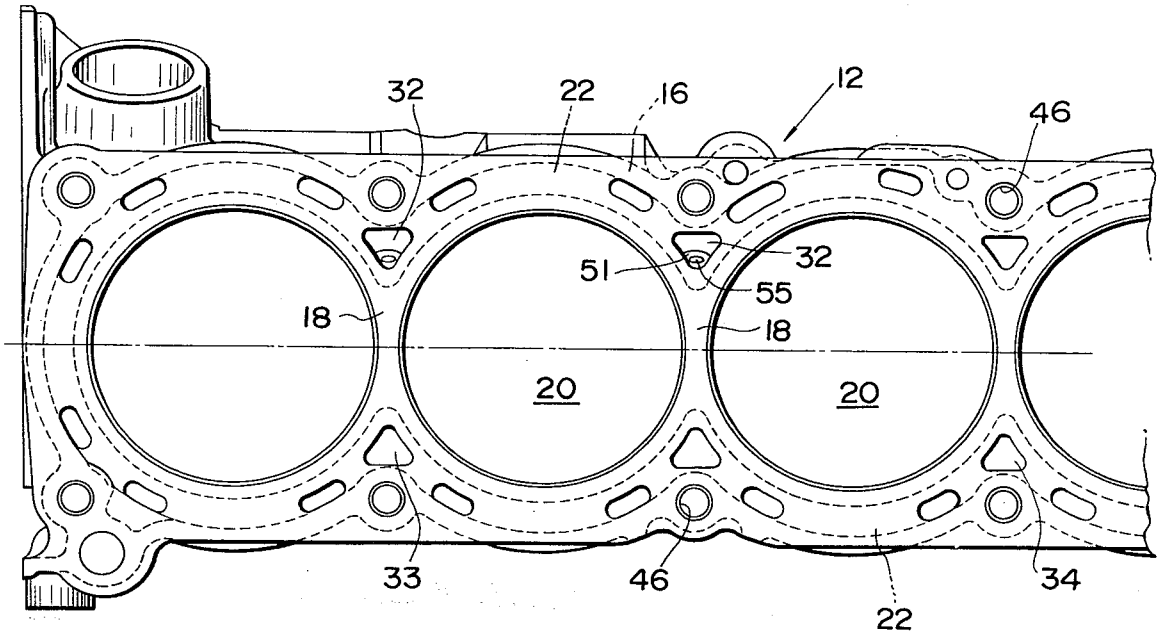
FIG. 3 is a plan view of a cylinder block of FIG. 1, wherein is illustrated the cylinder block having four combustion chambers for a four cylinder type internal combustion engine.

Referring to the drawings, particularly to FIGS. 1 to 4, there is illustrated a cylinder assembly 10 of an internal combustion engine to be mounted on an automotive vehicle. Although, as apparent from FIG. 3, there is illustrated a four-cylinder combustion engine, the number of the engine cylinders formed in the cylinder assembly is not limited to the specific number shown. The cylinder assembly 10 generally comprises a cylinder block 12 and a cylinder head 14. Generally, the cylinder block is made of cast metal such as cast iron, which has a relatively high heat-resistance and the cylinder head is made of a relatively light weight case metal, such as alminum. The cylinder block 12 has a wall 16 consisting of a peripheral portion and a plurality of partitions 18. The wall 16 and the partitions 18 define a plurality of engine cylinders 20 in-line within the cylinder block 12. The cylinder wall 16 has formed therein a coolant chamber 22 filed with coolant, such as cooling water. The coolant chamber 22 surround a substantial part of the lined engine cylinders 20 along the cylinder wall 16. The coolant chamber 22 communicates with a radiator 24 through an intake passage 26. At the outlet 28 of the intake passage 26, there is provided a circulating pump 30 for generating a current within the coolant chamber 22 to cause the coolant to circulate therewithin. Opposing the radiator 24, there is a radiator fan 25 for generating or increasing the velocity of a current of ambient air to effectively cool the casing of the radiator 24 and thereby to cool the coolant flowing therethrough. Although not clearly illustrated in the drawings, the radiator fan 24 is mechanically connected to the engine output shaft in a know manner so as to be driven in synchronism therewith. At both sides of each partition 18, vertical passages 32 and 33 of generally triangular shaped configration in section extend upwardly from the top of the coolant chamber 22 and open at the upper surface 34 of the cylinder block 12. As shown in FIG. 3, the vertical passages 32 and 33 are positioned at opposed positions along the of top of the block. The passages 32 are located in-line along one longitudinal side of the cylinder wall 16. The passages 33 are located inline along the other longitudinal side of the cylinder wall. The cylinder head 14 is formed with a return passage 36 for recirculating the coolant to the radiator 24. The return passage 36 comprises a lateral portion 38 communicating with the radiator 24 through a thermostat 39 and a plurality of vertical portions 40 located in alignment with the vertical passages 32 and 33, and extending downwardly from the lateral portion 38.

Between the mating surfaces of the cylinder block 12 and the cylinder head 14, a sealing member 42 such as heat resistant elastic sealing rubber is disposed for liquid and gas sealing purposes. The sealing member 42 is also formed with a plurality of apertures 44 corresponding to the vertical passages 32 and 33 for establish communication between the vertical passages 32 and 33 and the vertical portion 40 of the return passage 36.

Figure 4:
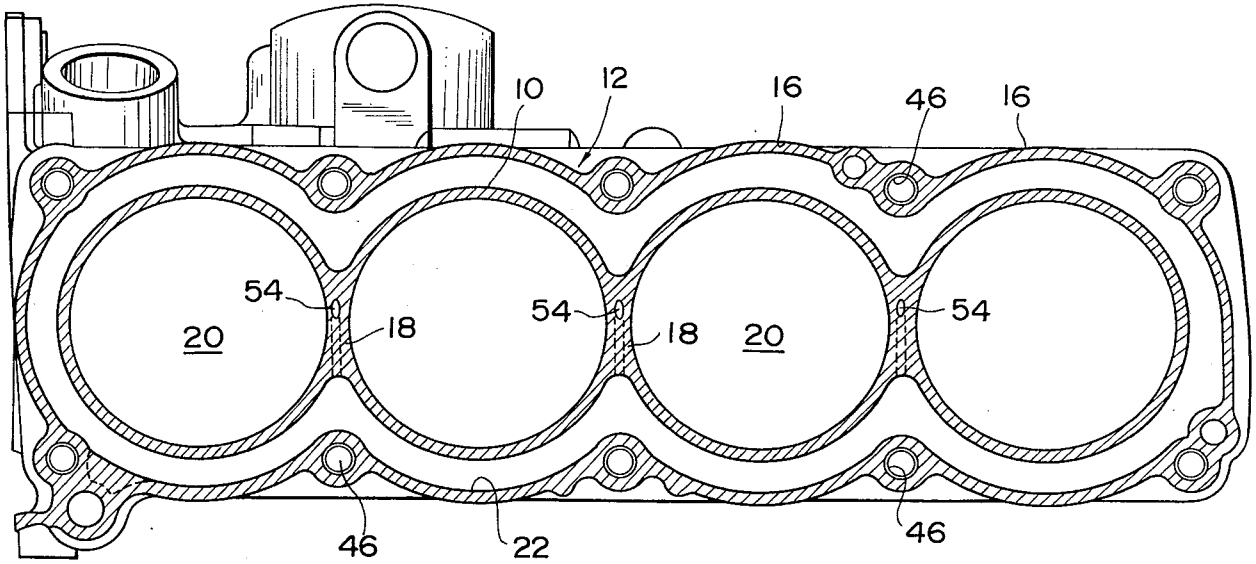
FIG. 4 is a transverse sectional view of the cylinder assembly of FIG. 1, taken along line IV—IV of FIG. 1.

As shown in FIGS. 2 and 4, at the outer side of the vertical passages 32 and 33, the cylinder block 12 is formed with a threaded bore 46. Corresponding to the threaded bore 46, the cylinder head 14 is formed with an elongated opening 48 extending through the periphery thereof. Through the opening 48, a fastening screw 50 engages with the threaded bore 46 so as to fixedly mount the cylinder head 14 onto the upper surface of the cylinder block 12.

Adjacent the top of the vertical passage 32, there is formed with an inwardly projecting portion 52 protruding into the passage 32. From the upper sloped surface 51 of the projecting portion 52, a sloped narrow passage 54 extends to the upper portion of the coolant chamber 22 at the portion located at the opposite side of the vertical passage 32 with respect to the partition 18. As apparently shown in FIG. 2, the sloped passage 54 has an upper end 55 opening at the upper planar surface 51 of the projecting portion 52. The upper end 55 of the sloped passage 54 opens at a right angle to the projecting portion 52. Thus, the sloped passage tilts left-side-up in FIG. 2. In a specific embodiment, the sloped passage 54 is of 2 to 5 milimeter in diameter and tilted at an angle $\theta$ in a range of 15 to 55 degree, preferably 20 to 38 degree with respect to the horizontal upper surface of the cylinder block 12. Preferably, another projecting portion 60 is formed adjacent the top of the portion of coolant chamber 20 located at the opposite side of the vertical passage 32 with respect to the partition 18 so that the coolant will easily flow through the sloped passage 54 and thereby effectively circulate to the opposite side and to the radiator 24 through the return passage 36.

The coolant circulates from the radiator 24 to the coolant chamber 22 through the circulating pump 30. By the pump 30, the coolant is energized to circulate through the coolant chamber 22. The coolant flows through the vertical passage 32 and the vertical portion 40 to the lateral portion 38 of the return passage 36. Then, the coolant recirculates to the radiator 24. During the circulation within the coolant chamber 20, the coolant flows through the sloped passage 54 from the lower end 57 to the upper end 55. Meanwhile, since the projecting portions 52 and 60 respectively protrude into the vertical passage 32 and the coolant chamber 22 to form venturi together with the opposing vertical inner wall of the passage 32 and coolant chamber 22, the velocity of the coolant flowing therethrough is increased. Therefore, at the projecting portion 60, the coolant having an increased velocity of circulation will enter into the passage 54. On the other hand, because the upper end 55 of the passage 54 opens at the sloped upper surface 51 of the projecting portion, vacuum pressure will be generated by the venturi to draw the coolant through the passage 54 from the lower end 57 to the upper end 55 thereof. In the specific construction of the cylinder assembly according to the present embodiment, by tilting the sloped passage 54 at 20 to 38 degree with respect to the horizontal surface of the cylinder block, the sloped passage 54 is oriented in a vertical direction to cover at least the portion of the partition corresponding to the upper half of the piston at the upper dead-point thereof. In the present embodiment, the partition temperature within a area corresponding to the piston positions from the upper dead-point to the lower position, at which the crank angle is 90° from the former position, is maintained less than 160 degrees centrigrade. This means the partition can be effectively cooled by providing the sloped passage 54 in a titled position. During the coolant recirculation to the return passage 36, the thermostat 39 measures the coolant temperature. The thermostat will be electrically or mechanically incorporated with the circulation pump 30 to vary the operation of the latter corresponding to the measured coolant temperature.

For forming the projecting portions 52 and 60, it is preferred that, upon casting the cylinder block in the mold, a core having dents at the corresponding locations to the overhung portions is inserted. After stiffening the melted metal in the mold, the core, such as sand, is removed. Thereafter, the narrow passage is formed by means of a tool such as drill. Since the upper end 55 of the sloped passage 54 opens at a right angle to the upper surface of the projecting portion 52 and the upper portion of the projecting portion is located adjacent the top opening of the vertical passage 32, the pssage is easy to form without damaging the tool used. This will increase efficiency of manufacturing to form the passage. At this a, drill can proceed from the upper surface of the overhung portion 52 at the prescribed angle.

Figure 5:
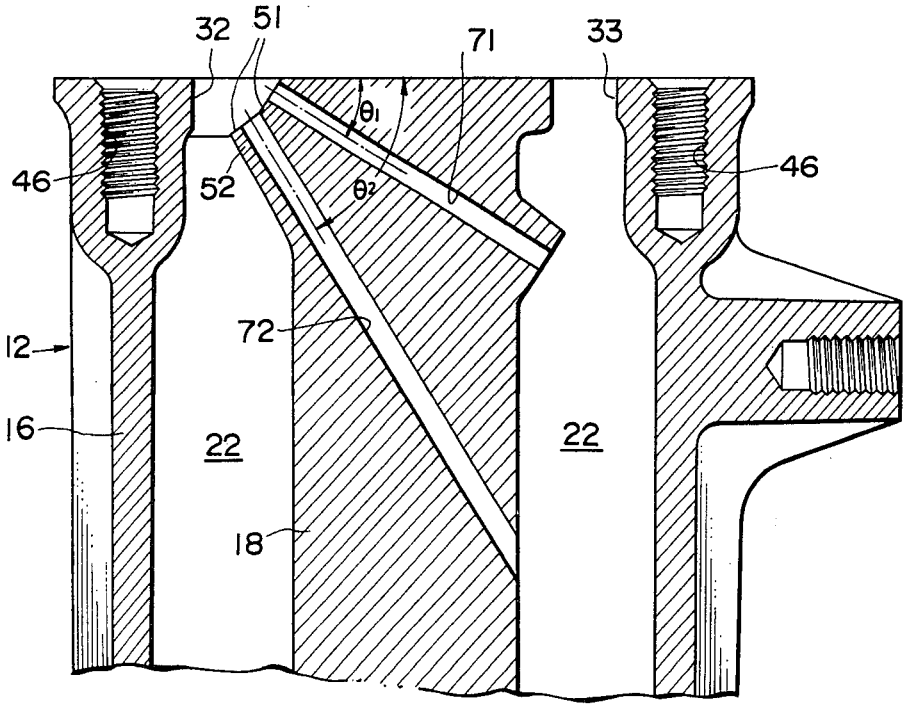
FIG. 5 is an enlarged sectional view of a cylinder block including a part of a coolant circulating system according to the second embodiment of the present invention.

Referring to FIG. 5, there is illustrated another embodiment of the present invention. In this embodiment, the construction of the cylinder assembly is substantially similar to the foregoing embodiment. Therefore, the features and elements having the same construction and function will be represented by the same reference numerals as the foregoing embodiment. In a partition 18, there are formed two sloped passages 70 and 72 which are respectively tilted at $\theta_1=20°-38°$ and $\theta_1<\theta_2<55°$. In this embodiment, the passages 70 and 72 can cover the area of the partition corresponding to the full extent of the piston stroke of the internal combustion engine so as to more effectively cool the partition.

According to the above-mentioned embodiments of the present invention, the partition can be made thinner than that of the conventional ones, since it can be effectively cooled.

Figure 6:
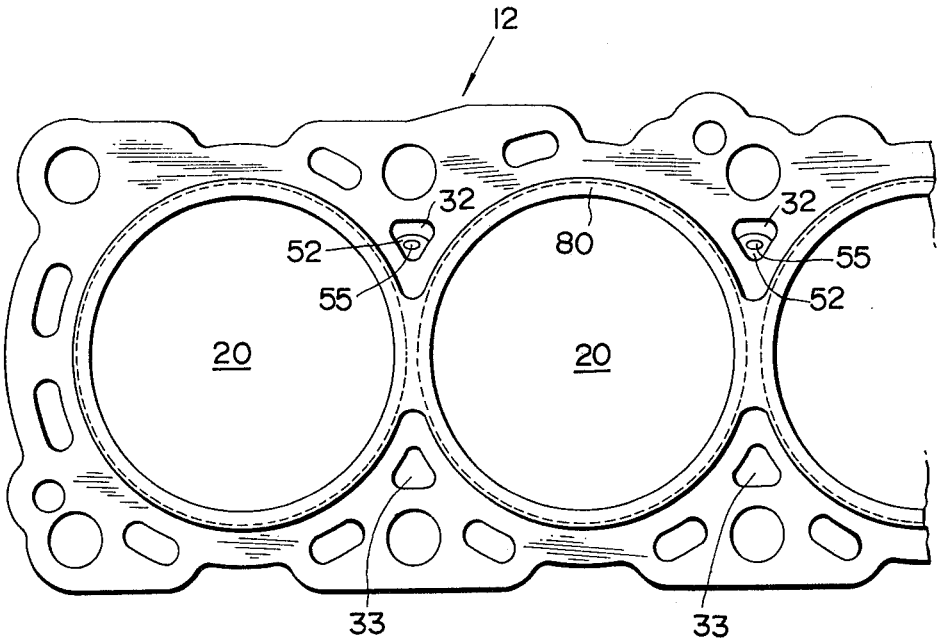
FIG. 6 is a plan view of the cylinder assembly having a sealing member at the top of each of the combustion chambers, the cylinder block being formed with the coolant circulating system according to either the first or second embodiment of the present invention.
Figure 7:
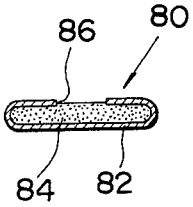
FIG. 7 is an enlarged sectional view of the sealing member applicable to the cylinder block of FIG. 6.
Figure 8:
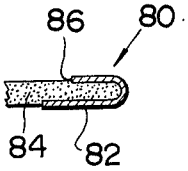
FIG. 8 is an enlarged partial sectional view of the sealing member, showing the modification of the sealing member of FIG. 7.

FIG. 6 shows a modification of the first embodiment of the present invention wherein a sealing member 80 is provided at the top edge of the engine cylinder 20. The sealing member 80 comprises a grommet 82 made of stainless steel or the like and formed into a substantially C-shaped configuration in cross section. Within the grommet, heat resistant sealer 84, such as asbestos with meshed wire is provided. The grommet 82 is separated at the ends thereof to define a elongated groove 86 therealong. Through the groove 86, the sealer is exposed. The sealer exposed through the groove 86 is mated to the lower surface of the cylinder head 14. On the other hand, the opposite surface of the grommet 82 is mated to the upper surface of the cylinder block 12. Since the cylinder block 12 is relatively heat resistant and will expand at a comparably small rate, the grommet 82 can be forced against the mating surface with an even force and thereby effectively seal against leakage of air/fuel mixture in the combustion chamber discharged from the intake manifold. Further, in accordance with the present modification, since the sealer is mated to the cylinder head, it permits the force for securing the cylinder head onto the cylinder block to be increased to effectively seal the clearance therebetween.

Thus, the present invention fulfills all of the objects and advantages sought therein.

While, however specific constructions are disclosed hereabove for illustration of the present invention, it will be possible to modify various features or elements consisting of the present invention. Therefore, the present invention should not be limited to the specific embodiments of the present invention disclosed and should be understood to include any modifications without departing from the principle of the present invention.

What is claimed is:

1. A cylinder assembly for an internal combustion engine comprising:

a cylinder block having a plurality of partitions arranged in parallel relationship with respect to one another and defining therebetween a plurality of combustion chambers arranged in-line, said cylinder block defining a coolant chamber for circulating an engine coolant therethrough;

a cylinder head mounted on said cylinder block and defining therein a coolant return passage for recirculating the engine coolant to a radiator for radiating the heat of the coolant;

a plurality of vertical passages defined in said cylinder block for communication between said coolant chamber and said return passage, said vertical passages being located at opposite ends of said partitions;

projecting portions provided on the internal periphery of certain associated ones of said vertical passages and protruding laterally toward said associated vertical passages, each of said projecting portions being located adjacent the upper end of said associated vertical passages and having an upper plane surface below said upper end, which plane surface is angled downwardly with respect to the horizontal and projects into the vertical passage; and a plurality of communication passages defined in respective ones of said partitions for communication between vertical passages respectively located on opposite ends of said partitions, each said communication passage being respectively tilted so that the longitudinal axis thereof intersects said plane surface of said projecting portion at a right angle and the vertical dimension thereof extends at least over the upper half of one of said combustion chambers.

2. A cylinder assembly for an internal combustion engine comprising:

a cylinder block having a plurality of partitions arranged in parallel relationship with respect to one another and defining therebetween a plurality of combustion chambers arranged in-line, said cylinder block defining a coolant chamber for circulating an engine coolant therethrough;

a cylinder head mounted on said cylinder block and defining therein a coolant return passage for recirculating the engine coolant to a radiator for radiating the heat of the coolant;

a plurality of vertical passages defined in said cylinder block for communication between said coolant chamber and said return passage, said vertical passages being respectively located at the ends of said partitions, and extending vertically from the upper end of said coolant chamber and opening at the top of the cylinder block;

projecting portions respectively protruding laterally into said vertical passages, said projecting portions having upwardly inclined plane surfaces directed to face toward the top openings of the vertical passages, each of said plane surfaces having a lower end projecting into the vertical passage, said plane surfaces being disposed at a given angle with respect to a horizontal plane; and a plurality of communication passages extending in respective partitions and communicating vertical passages located on opposite ends of said partitions, each said communication passage having an upper end opening in one of said plane surfaces so that the longitudinal axis thereof crosses said one of said plane surfaces at a right angle.

3. A cylinder assembly for an internal combustion engine comprising:

a cylinder block having a plurality of partitions arranged in parallel relationship with respect to one another for defining therein a plurality of combustion chambers arranged in-line, said cylinder block defining a coolant chamber for circulating an engine coolant therethrough, said coolant chamber surrounding most of said combustion chambers;

a cylinder head mounted on said cylinder block and defining therein a return passage for recirculating the coolant to a radiator therethrough;

a plurality of vertical passages extending vertically at respective ends of said partitions and opening to the top of said cylinder block, said vertical passages respectively establishing communication between said coolant chamber and said return passage for circulating the coolant from said coolant chamber to said return passage therethrough, said vertical passages including first vertical passages aligned on one side of said cylinder block and second vertical passages aligned on the other side of said cylinder block, said first and second passages being opposed to each other with respect to said partitions;

projecting portions provided on the internal periphery of said first vertical passages and laterally extending therefrom, said projecting portions being located adjacent the tops of respective first vertical passages and respectively having plane surfaces directed towards said top openings of said first vertical passages in angled position; and a plurality of communication passages respectively extending through said partitions for communication between opposing said first and second vertical passages, each said communication passage having a longitudinal axis respectively titled with respect to a horizontal plane and so it crosses one of said plane surfaces at a right angle.

4. The cylinder assembly as set forth in claims 1, 2 or 3, wherein a sealing member is disposed between the top of said cylinder block and said cylinder head, said sealing member comprising an elastic sealer and a metal grommet surrounding said sealer.

5. The cylinder assembly as set forth in claims 1, 2 or 3, wherein a sealing member is disposed between the top of said cylinder block and said cylinder head, said sealing member comprising an elongated thin strip of elastic sealer and pair of metal grommets extending along both longitudinal edges of said sealer so that said sealer is exposed between said edges.

6. The cylinder assembly as set forth in claims 1, 2 or 3, wherein said vertical passages are of triangular-shaped configuration in transverse section, each said triangular vertical passage being arranged so that the top thereof aligns with the longitudinal axis of one of said communication passages.

7. The cylinder assembly as set forth in claims 1, 2 or 3, wherein each of said plane surfaces in angled at the intermediate portion thereof in order form an angled two plane surface, a pair of said communication passages extending from a different plane of said two plane surface and in which the longitudinal axis of each communication passage crosses the plane surface from which it extends at a right angle.

8. The cylinder assembly as set forth in claims 1, 2 or 3, wherein the longitudinal axis of each of said communication passages is titled at an angle in the range of 15 degrees to 55 degrees.

9. The cylinder assembly as set forth in claim 8, wherein the longitudinal axis of each of said communication passages is titled with respect to a horizontal plane at an angle in the range of 20 degrees to 38 degrees.

10. A light weight cylinder assembly of an internal combustion engine comprising:

a cylinder block having a plurality of relatively thin partitions for defining therein a plurality of combustion chambers arranged in-line, said cylinder block defining a coolant chamber surrounding a large part of said combustion chambers and circulating an engine coolant therethrough;

a cylinder head mounted on said cylinder block and defining therein a return passage for recirculating the coolant to a radiator therethrough;

a plurality of vertical passages extending vertically along respective ends of said partitions and respectively opening at the top of said cylinder block in alignment with respective openings in said cylinder head leading to said return passage, which vertical passages establish communication between said coolant chamber and said return passage and permit the coolant in the coolant chamber to flow to said return passage; and a plurality of communication passages respectively extending through said partitions for communication between said vertical passages located on one end of a respective partition and a cooling chamber portion located on an opposite end of said respective partition, each of said communication passages being vertically tilted so that the vertical dimension thereof extends at least over the upper half of one of said combustion chambers.

11. A siamese-type light weight cylinder assembly with in-line engine cylinders for an internal combustion engine, comprising:

a cylinder block provided with a plurality of relatively thin partitions arranged in parallel relationship with respect to one another for defining in-line engine cylinders;

a coolant chamber defined in said cylinder block and extending around said cylinder block so that it surrounds the outer most portion of said engine cylinders;

a cylinder head defining therein a return passage for recirculating an engine coolant circulated through said coolant chamber to a radiator;

a plurality of vertical passages extending vertically at respective ends of said partitions and in substantially parallel relation to said engine cylinders in alignment with respective openings in said cylinder head leading to said return passage, and a plurality of communication passages respectively extending through said partitions and establishing communication between said vertical passages located at one end of a respective partition and a cooling chamber portion located on an opposite end of said respective partition, each of said communication passages having one end opening adjacent the top of one of two vertical passages and the other end opening adjacent the lower end of the other of said two vertical passages and extending through a vertical dimension corresponding to at least the upper half said engine cylinders.

12. The cylinder assembly as set forth in claims 10 or 11, wherein a sealing member is disposed between the top of said cylinder block and said cylinder head, said sealing member comprising an elastic sealer and a metal grommet surrounding said sealer.

13. The cylinder assembly as set forth in claims 10 or 11, wherein a sealing member is disposed between the top of said cylinder block and said cylinder head, said sealing member comprising an elongated thin strip of elastic sealer and pair of metal sealer so that said sealer is exposed between said edges.

14. The cylinder assembly as set forth in claims 10 or 11, wherein said vertical passages are of triangular-shaped configuration in transverse section, said triangular vertical passages being arranged so as to align with the longitudinal axis of one of said communication passages.

15. The cylinder assembly as set forth in claims 10 or 11, wherein said cylinder head assembly further includes projecting portions protruding laterally into said vertical passages, said projecting portions having upwardly inclinded plane surfaces directed to face toward the top openings of the vertical passages, each of said plane surfaces being angled at the intermediate portion thereof in order to form an angled two plane surface, a pair of said communication passages extending from a different plane of said two plane surface and in which the longitudinal axis of each communication passage crosses the plane surface from which it extends at a right angle.

16. The cylinder assembly as set forth in claim 10 or 11, wherein the longitudinal axis of each of said communication passages is tilted at an angle in the range of 15 degrees to 55 degrees.

17. The cylinder assembly as set forth in claim 16, wherein the longitudinal axis of each of said communication passages is tilted with respect to a horizontal plane at an angle in the range of 20 degrees to 38 degrees.

* * * * *